US006718573B2

(12) United States Patent
Von Schroeter

(10) Patent No.: US 6,718,573 B2
(45) Date of Patent: Apr. 13, 2004

(54) INVALID HOIST

(75) Inventor: Philip Von Schroeter, Rodenbach (DE)

(73) Assignee: Arjo. Med. Aktiebolag Limited, Gloucester (GB)

( * ) Notice: Subject to any disclaimer, the term of this patent is extended or adjusted under 35 U.S.C. 154(b) by 44 days.

(21) Appl. No.: 10/260,336

(22) Filed: Oct. 1, 2002

(65) Prior Publication Data

US 2003/0070227 A1 Apr. 17, 2003

(30) Foreign Application Priority Data

Oct. 3, 2001 (GB) ..... 0123690

(51) Int. Cl.[7] ..... A61G 7/10
(52) U.S. Cl. ..... 5/86.1; 5/81.1 R
(58) Field of Search ..... 5/81.1 R, 85.1, 5/86.1, 87.1; 414/921; 177/147, 229

(56) References Cited

U.S. PATENT DOCUMENTS 5,892,180 A * 4/1999 Carey ..... 177/144
6,175,973 B1 * 1/2001 Hakamiun et al. ..... 5/89.1

FOREIGN PATENT DOCUMENTS

| | | |
|---|---|---|
| GB | 2 184 706 | 7/1987 |
| GB | 2 189 219 | 10/1987 |
| GB | 2 297 307 | 7/1996 |

* cited by examiner

*Primary Examiner*—Teri Pham Luu
*Assistant Examiner*—Fredrick Conley
(74) *Attorney, Agent, or Firm*—Young & Thompson

(57) ABSTRACT

A mobile invalid hoist comprises a non-rectilinear lifting arm pivotably connected about first horizontal axis to the upper end of mast, a housing pivotably connected about second horizontal axis to one end of the lifting arm and supporting a vertical bearing, a sling hanger support pivotably supported about a vertical or substantially vertical axis by the bearing, and a sling hanger pivotably supported about a third horizontal axis by the sling hanger support. A flexible elongate element is connected between the mast and housing, and is guided through the lifting arm to effectively form with the lifting arm a parallelogram linkage. Thus, as the lifting arm pivots, the housing pivots in relation to the lifting arm and the bearing is kept vertical or substantially vertical.

10 Claims, 3 Drawing Sheets

INVALID HOIST

BACKGROUND OF THE INVENTION

This invention relates to an invalid hoist.

It is known from GB-A-2189219 to provide an invalid hoist comprising a mobile chassis, a support structure or mast upstanding from the chassis, a lifting arm connected to the upper end of the support structure or mast for pivotable movement about a first horizontal axis, a housing supporting a vertical bearing at one end of the lifting arm, the housing being pivotable relative to the lifting arm about a second horizontal axis, a sling hanger support supported by the bearing for pivotable movement about a vertical or substantially vertical axis, and a sling hanger supported by the sling hanger support for pivotable movement about a third horizontal axis. The lifting arm comprises two rigid links of a parallelogram linkage, one of the links being disposed within a central space within the other link. The parallelogram linkage maintains the vertical orientation of the bearing and a safe and compact lifting arm construction is provided by disposing one link within the other.

However, for ergonomic and aesthetic reasons, it is often preferred today to use non-rectilinear lifting arms and, in this case, it is not possible to form a parallelogram linkage from two rigid links, one within the other.

The present invention seeks to overcome this problem.

SUMMARY OF THE INVENTION

According to the present invention, there is provided an invalid hoist comprising a mobile chassis, a support structure or mast upstanding from the chassis, a non-rectilinear lifting arm connected to the upper end of the support structure or mast for pivotable movement about a first horizontal axis, a housing supporting a vertical bearing at one end of the lifting arm, the housing being pivotable relative to the lifting arm about a second horizontal axis, a sling hanger support supported by the bearing for pivotable movement about a vertical or substantially vertical axis and a sling hanger supported by the sling hanger support for pivotable movement about a third horizontal axis, wherein a flexible elongate element is connected between the support structure or mast and the housing in spaced relationship to the first and second horizontal axes, respectively, and is guided through the lifting arm to effectively form with the lifting arm a parallelogram linkage between the support structure or mast and the housing so that, as the lifting arm pivots, the housing pivots in relation to the lifting arm to keep the bearing vertical or substantially vertical.

Preferable and/or optional features of the present invention are set out in claims 2 to 10, inclusive.

The invention will now be more particularly described, by way of example, with reference to the accompanying drawings.

DETAILED DESCRIPTION OF THE PREFERRED EMBODIMENTS

Figure 1:
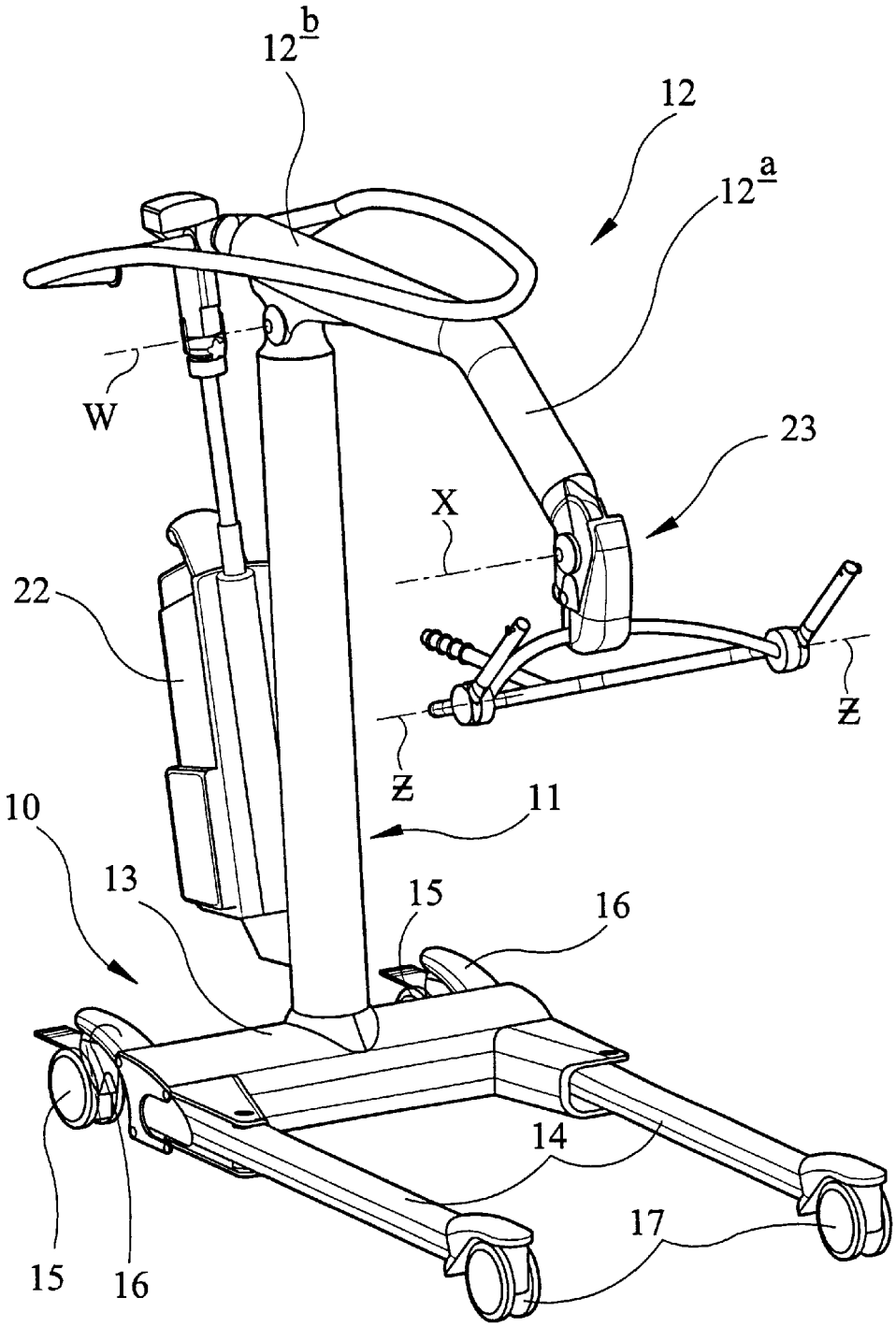
FIG. 1 is a perspective view of an invalid hoist having a lifting arm in accordance with the present invention.
Figure 2:
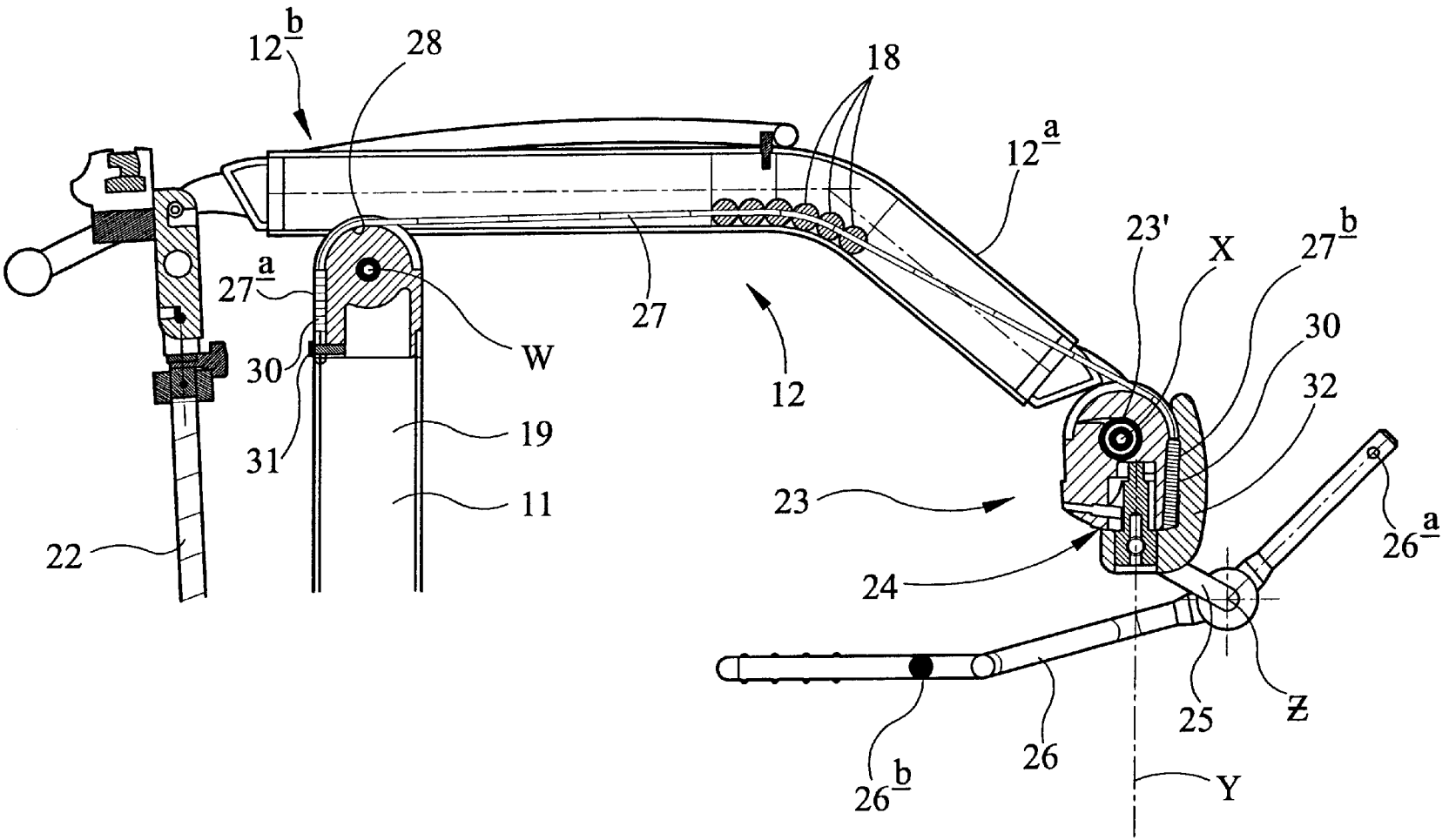
FIG. 2 is a side view, partially in section, of the lifting arm of the hoist shown in FIG. 1.

Referring to FIGS. 1 and 2 of the drawings, the invalid hoist shown therein comprises a mobile chassis 10, a support structure in the form of a mast 11 upstanding from the chassis 10, and a lifting arm 12 supported by the mast 11.

As shown, the chassis 10 comprises a main chassis portion 13 extending transversely of the hoist and two side members 14. The side members 14 are pivotable relative to the main chassis portion 13 in a common horizontal plane to increase the width of the front opening of the chassis 10 to fit around, for example, a wheelchair.

The main chassis portion 13 is provided with two wheels or castors 15 supported by brackets 16 and each side member 14 is provided with a single wheel or castor 17 provided at or adjacent to its front end.

The lifting arm 12 is pivotably connected to the upper end of mast 11 for angular displacement about a first horizontal axis W. The lifting arm 12 has a first limb 12*a* which extends forwardly of the mast 11 and a second relatively shorter limb 12*b* which extends rearwardly of the mast 11. The rear end of the limb 12*b* is connected by a linear actuator 22 to the mast 11 at a position adjacent to the base of the mast 11 so that, when the actuator 22 is extended, the lifting arm 12 will pivot downwards and, when the actuator 22 is retracted, the lifting arm 12 will pivot upwards.

The actuator 22 is powered by a rechargeable battery (not shown) mounted in a compartment (not shown) at the rear of the actuator 22.

The lifting arm 12 includes a housing 23 pivotably connected to the front end of the lifting arm 12 for angular displacement about a second horizontal axis X. The housing 23 supports a vertical bearing 24 which in turn supports a sling hanger support 25 for pivotable movement about a vertical or substantially vertical axis Y. The sling hanger support 25 is pivotably connected to a sling hanger 26 for angular displacement about a third horizontal axis Z.

The sling hanger 26 has two widely spaced sling attachment points 26*a* on one side of the third horizontal axis Z and two more closely spaced sling attachment points 26*b* on the other side of the third horizontal axis Z. A single body support sling (not shown) can then be attached to the sling attachment points 26*a*, 26*b* to support a patient.

The two sling attachment points 26*b* could be replaced by a single attachment point.

As shown in FIG. 2, the lifting arm 12 is hollow and non-rectilinear, having a bend intermediate its ends. A flexible elongate element 27, such as a high-tensile wire, cable or tape, passes through the lifting arm 12 and is connected between the upper part 19 of the mast 11 and the housing 23 in spaced relationship to the first and second horizontal axes W and X, respectively. The flexible elongate element 27 is guided around the upper end of the mast 11 by an arcuate guide member 28, through the lifting arm 12, and around a part circular surface of the housing 23.

The vertical axis Y is offset from a vertical plane containing the horizontal axis X and is on that side of the said vertical (as shown, that side being the side remote from the mast 11) so that, when in use a person is suspended in a sling from the sling hanger 26, the load applied to the housing 23 will apply tension to the flexible elongate element 27.

Spring means, typically in the form of at least one torsion spring 23', is provided on the housing 23. The spring means acts to apply a light turning moment to the housing 23, urging the housing 23 angularly about the horizontal axis X, to apply tension to the flexible elongate element 27, even when the sling hanger 26 is under no load.

Balls (or rollers) 18 are threaded onto the flexible elongate element 27 in the region of the bend in the lifting arm 12 to guide the flexible elongate element 27 around the bend. The balls are held in place by retaining means, such as clips (not shown).

The ends 27*a* and 27*b* of the flexible elongate element 27 are formed with head elements 30 which are held in place by bosses 31 and 32 formed on the upper part 19 of the mast 11 and housing 23, respectively. The flexible elongate element 27 therefore has a set predetermined length which, in conjunction with the lifting arm 12, effectively forms a parallelogram linkage between the mast 11 and the housing 23. Consequently, as the lifting arm 12 pivots, the housing 23 pivots in relation to the lifting arm 12, thereby keeping the bearing 24 vertical or substantially vertical.

Figure 3:
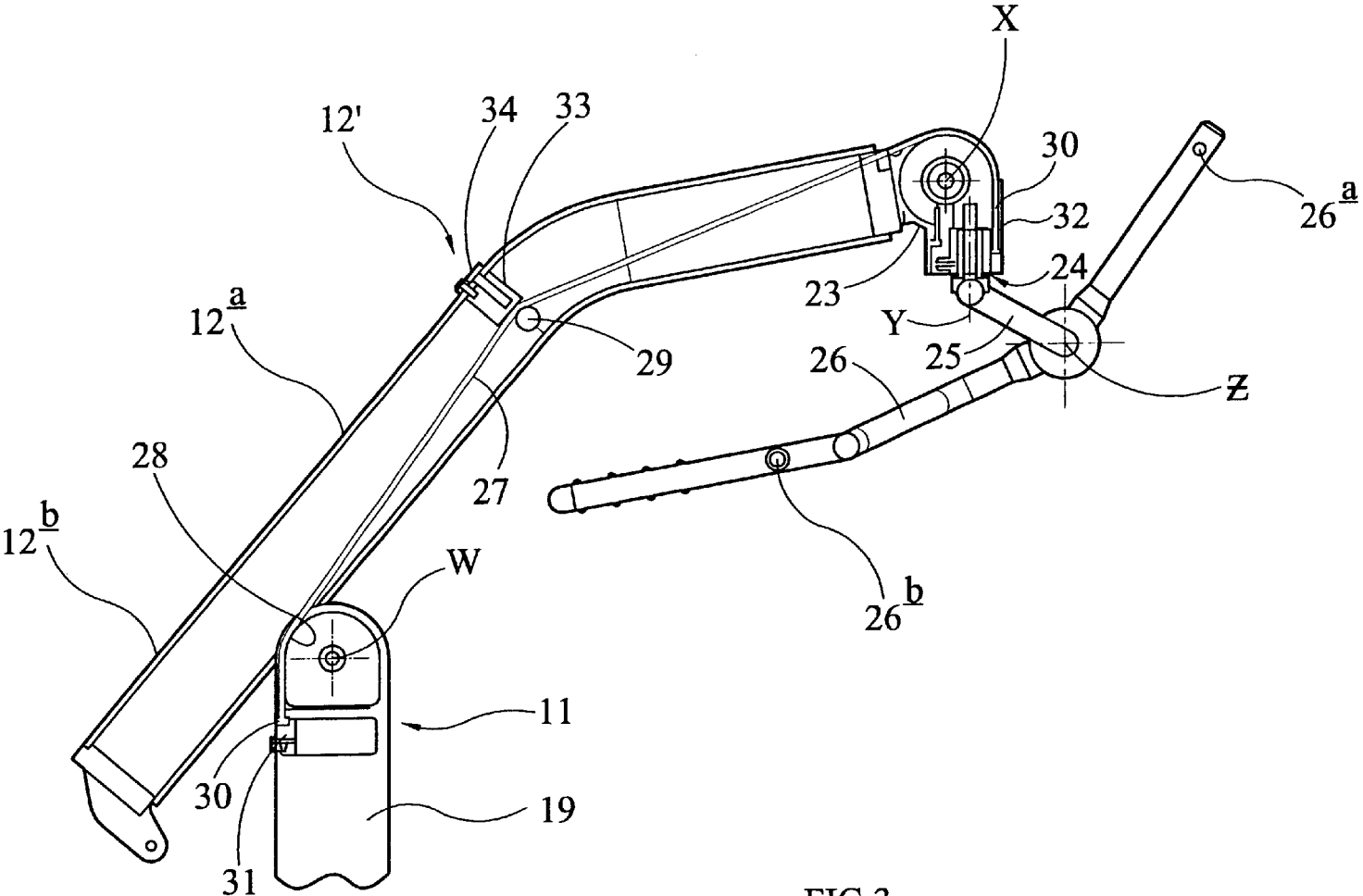
FIG. 3 is a view similar to FIG. 2, but showing an alternative lifting arm.

Referring now to FIG. 3, lifting arm 12' includes means for adjusting the verticality of the vertical bearing 24. This is in order to be able to compensate for tolerances and wear, for example if the flexible elongate element 27 stretches through use.

The adjusting means includes a guide member 29 which guides the flexible elongate element 27 around the bend in the lifting arm 12', and an adjustment mechanism 33 by which the position of the guide member 29 can be changed. The adjustment mechanism 33 is mounted on a top portion of the lifting arm 12' and extends into the hollow interior of the lifting arm 12'. The adjustment mechanism 33 includes a screw-threaded device 34 which is typically a manual device and which acts to raise or lower the guide member 29 relative to the interior surface of the lifting arm 12'. This has the effect of altering the angle through which the flexible elongate element 27 operates, and thus angularly displacing the bearing 24 relative to the vertical.

It should be realised that, although the screw-threaded device 34 of the adjustment mechanism 33 is a manual device, it would be a straightforward matter to motorise it.

It is therefore possible to provide a non-rectilinear lifting arm of an invalid hoist with what is effectively a parallelogram linkage arrangement while maintaining the compact nature and aesthetic appeal of the lifting arm by having one of the links safely and completely or substantially completely enclosed within the other.

The embodiment described above is given by way of example only and various modifications will be apparent to persons skilled in the art without departing from the scope of the invention.

What is claimed is:

1. An invalid hoist comprising a mobile chassis, a support structure or mast upstanding from the chassis, a non-rectilinear lifting arm connected to the upper end of the support structure or mast for pivotable movement about a first horizontal axis, a housing supporting a vertical bearing at one end of the lifting arm, the housing being pivotable relative to the lifting arm about a second horizontal axis, a sling hanger support supported by the bearing for pivotable movement about a vertical or substantially vertical axis and a sling hanger supported by the sling hanger support for pivotable movement about a third horizontal axis, wherein a flexible elongate element is connected between the support structure or mast and the housing in spaced relationship to the first and second horizontal axes, respectively, and is guided through the lifting arm to effectively form with the lifting arm a parallelogram linkage between the support structure or mast and the housing so that, as the lifting arm pivots, the housing pivots in relation to the lifting arm to keep the bearing vertical or substantially vertical.

2. An invalid hoist as claimed in claim 1, wherein the vertical or substantially vertical axis is offset from a vertical plane containing the second horizontal axis and is on that side of said vertical plane so that when in use a person is suspended in a sling from the sling hanger, the load applied to the housing will apply tension to the flexible elongate element.

3. An invalid hoist as claimed in claim 1, wherein spring means urge the housing angularly about the second horizontal axis in a sense which applies tension to the flexible elongate element.

4. An invalid hoist as claimed in claim 1, wherein the non-rectilinear lifting arm includes a bend, and balls or rollers are threaded onto the flexible elongate element to guide the flexible elongate element around the bend.

5. An invalid hoist as claimed in claim 1, further comprising means for adjusting the verticality of the vertical bearing supported by the said housing.

6. An invalid hoist as claimed in claim 5, wherein the adjusting means includes a guide member, which is disposed in the lifting arm intermediate the first and second horizontal axes and which guides the flexible elongate element, and an adjustment mechanism by which the position of the guide member can be adjusted to alter an angle through which the flexible elongate element operates.

7. An invalid hoist as claimed in claim 6, wherein the adjustment mechanism is manually operable.

8. An invalid hoist as claimed in claim 6, wherein the non-rectilinear lifting arm includes a bend and the guide member is positioned to guide the flexible elongate element around the bend.

9. An invalid hoist as claimed in claim 1, wherein the flexible elongate element is a high-tensile wire or cable.

10. An invalid hoist as claimed in claim 1, wherein the flexible elongate element is a tape.

* * * * *